United States Patent [19]

Silbert et al.

[11] 4,152,115

[45] May 1, 1979

[54] PROCESS FOR IMPARTING WATER REPELLANCY TO FIBROUS CELLULOSIC TEXTILE MATERIALS BY ACYLATING WITH ISOPROPENYL ESTERS

[75] Inventors: Leonard S. Silbert; Samuel Serota, both of Philadephia; Gerhard Maerker, Oreland, all of Pa.

[73] Assignee: The United States of America as represented by the Secretary of Agriculture, Washington, D.C.

[21] Appl. No.: 878,040

[22] Filed: Feb. 15, 1978

[51] Int. Cl.[2] ..... D06M 13/20; C08B 3/02; D06M 1/14

[52] U.S. Cl. ..... 8/121; 536/63

[58] Field of Search ..... 8/121

[56] References Cited

U.S. PATENT DOCUMENTS

| | | | |
|---|---|---|---|
| 3,215,488 | 11/1965 | Suiter | 8/116.4 |
| 3,432,252 | 3/1969 | McKelvey et al. | 8/120 |
| 3,493,319 | 3/1970 | Berni et al. | 8/120 |
| 3,617,201 | 11/1971 | Berni et al. | 8/120 |
| 3,880,830 | 4/1975 | Marmer et al. | 8/121 |

*Primary Examiner*—Melvyn J. Marquis
*Assistant Examiner*—Maria S. Tungol
*Attorney, Agent, or Firm*—M. Howard Silverstein; William E. Scott; David G. McConnell

[57] ABSTRACT

Water repellancy is imparted to fibrous cellulosic textile material by applying to it, for a very short period of time, an isopropenyl ester containing a catalytic amount of an acid catalyst and then heat curing the treated material. Excellent water repellancy is obtained at a very low degree of substitution and a high degree of retention of tensile strength.

14 Claims, No Drawings

PROCESS FOR IMPARTING WATER REPELLANCY TO FIBROUS CELLULOSIC TEXTILE MATERIALS BY ACYLATING WITH ISOPROPENYL ESTERS

BACKGROUND OF THE INVENTION

1. Field of the Invention

This invention relates to a rapid process for imparting water repellancy to fibrous cellulosic textile materials and more particularly to a process wherein cellulosic textile materials are acylated with an isopropenyl ester and then heat cured in an acid catalyzed reaction.

2. Description of the Prior Art

Acylation of cellulosic textile materials such as cotton is known in the art. Acylation of cotton has been achieved principally by the following methods of esterification: (a) reaction with an acid chloride in dimethyl formamide solvent (Textile Res. J. 35, 365–376, 1965); (b) treatment with a benzene solution of the fatty acid and trifluoroacetic acid anhydride (Textile Res. J. 37, 706–7, 1967); (c) the Karrar method in which the cotton is first padded with aqueous sodium hydroxide and is then immersed in a carbon tetrachloride solution of an acid chloride (U.S. Pat. No. 1,897,026); and (d) reaction of dry sodium cellulosate with an acid chloride in dimethyl formamide. (JAOCS 48, 284–290, 1971). The effect of the nature and chain length of the fatty acid upon the physical properties of cotton cellulose is also known (Textile Res. J. 42, 161–167, 1972; Ibid., 34, 1102–1104, 1964; Ibid., 36, 828–837, 1966; Am. Dyestuff Reptr., 51, 428–430, 1962.)

The chemical reactions of enol esters, especially isopropenyl stearate, is also known (JAOCS, 48, 657–660, 1971; Ibid., 48, 373–375, 1971; Ibid., 45, 189–193, 1968; J. Org. Chem., 38, 174, 1973; Ibid., 29, 646–650, 1964; Ibid., 34, 2486–88, 1969; Ibid., 35, 2351–53, 1970; Ibid., 39, 3551–52, 1972).

Cellulosic textile materials have been esterified with sorbic acid and with unsaturated long chain fatty acids in the presence of trifluoroacetic acid (U.S. Pat. Nos. 3,617,201 and 3,493,319). Cotton has been partially esterified with long chain acid halides to make it resilient (U.S. Pat. No. 3,432,252).

BRIEF SUMMARY OF THE INVENTION

An object of this invention is to provide a rapid means of treating fibrous cellulosic textile materials to make them water repellant without any significant loss of tensile strength and with a minimum of add-on.

According to this invention the above object is accomplished by a process in which an isopropenyl ester having mixed with it a catalytic amount of an acid catalyst is applied to the material and the so treated material heat cured. The process imparts excellent water repellancy at a very low degree of substitution and a high degree of retention of tensile strength.

DETAILED DESCRIPTION OF THE INVENTION

The process of this invention is particularly attractive and advantageous, both practically and economically, because it affords, with a very brief treatment time, a water repellant cellulosic textile material that is durable to dry cleaning in neutral solvents. The rapidity of the reaction and the small degree of add-on that confers the useful property of water repellancy while retaining essentially all of the original tensile strength of the cellulosic textile material was totally unexpected. The process of this invention does not alter significantly the tear strength, color, appearance, hand or fibrous form of the cellulosic textile material.

Any long chain fatty isopropenyl ester in which the fatty moiety contains from 8 to 22 carbon atoms can be used in the process of this invention including the octanoate, palmitate, oleate, stearate, either singly or in combination.

The process may be carried out using the reagent neat or in solution. Any solvent which has good solubilizing action for both the isopropenyl ester and the catalyst, which is stable toward acylation by the isopropenyl ester and toward deterioration by acid catalysts, which has the proper volatility, and which is inert toward the cellulosic textile material is suitable.

In order to be suitable for this process, the acid catalyst must be able to catalyze the isopropenyl ester acylation of the cellulosic textile material without adversely affecting the physical properties of the latter. The preferred catalyst for the process of this invention is p-toluenesulfonic acid monohydrate (PTSA). Other catalysts that were found suitable are $\beta$-naphthalenesulfonic acid and partially dehydrated phosphoric acid.

The fibrous cellulosic textile material is acylated in our process under mild conditions with a very small amount of add-on to render the fabric water repellant. The water repellancy achieved by this process is permanent and is not removed by dry cleaning or other exposure to organic solvents such as perchlorethylene, Stoddard solvent, skellysolve, benzene, or other neutral solvents even though the treated fabric is completely wetted by these solvents.

The enol ester can be applied to the cellulosic textile in solution or neat. Neat application may be as a liquid melt containing at least a catalytic amount of PTSA or other catalyst or as a power. A powder is prepared by allowing the melt of ester and catalyst to solidify after which the solid is crushed to powder. Applied neat, that is, as a liquid melt or as a powder containing at least a catalytic amount of PTSA or other catalyst, the amount of ester may vary widely, yet the process consistently affords an esterified cellulosic textile material with a low degree of substitution. The amount of ester may vary from 0.01 mole of isopropenyl ester to 0.1 mole or more per mole of anhydroglucose. The amount of PTSA may also vary, but the preferred mole ratio of PTSA to isopropenyl ester is about $8.5\times10^{-4}$:1.

In practicing the invention, the cellulosic textile material is coated, padded, sprayed, or impregnated by immersion or other way with a solution or with the neat liquid melt or power of ester containing catalyst. The cellulosic material is then heated for from about one-tenth of a second to about fifteen seconds at temperatures between 130° C. and about 350° C. The heating may be accomplished with a flat iron, rollers, microwave, infared lamps, or an oven. Oven curing is accomplished by pinning the wetted material to a wooden frame, air-drying the material, and then heating it in an oven for the prescribed period. The treated material may then be extracted to remove unreacted ester and catalyst if desirable. The water repellant property of the treated material is evidenced by formation of globules on the fabric surface when water is sprayed upon it in accordance with the standard AATCC (American Association of Textile Chemists and Colorists) test.

Neat application of the ester is advantageous over solvent application in that the surface of the material to be treated is saturated without noticeable swelling of the cellulose fiber. Also, the pool of melted ester apparently facilitates heat transfer and gives a more rapid reaction of the fiber surface with the ester. Additionally, cellulosic textile material impregnated by dipping into benzene containing the ester and catalyst, then dried after excess solvent was squeezed out, and heat treated in one of the aforesaid ways is made water repellant but its tensile strength is diminished and its elongation is altered. A disadvantage of neat application is that the large excess of unreated ester and catalyst must be removed by solvent extraction or other means because the excess acid catalyst can be expected to degrade the cellulosic fiber in time. Furthermore, stability studies of isopropenyl stearate have indicated that while the ester itself is stable at room temperature for years, isopropenyl stearate containing PTSA has a tendency to degrade, one product being stearic anhydride. The rate of degradation of isopropenyl stearate is a function of the concentration of PTSA dissolved in it.

For the purposes of this invention, water repellancy was determined by AATCC Test Method 22-1971. Tensile strengths and percent elongations were determined by the ASTM Test Method D-1682-64 (70) on cloth strips (gauge length 1-in.) on an Instrom Tester Model TT-B. For the most part, tensile strength was determined separately in the warp (W) and fill (F) directions.

Determination and identification of chemically bound fatty acids (degree of substitution) present on partially esterified cellulosic textile material may be determined according to Textile Res. J. 39, 887–889, 1969. However, a faster microtechnique, which will be discussed later, is also available.

The process of our invention is illustrated in the following examples using cotton fabric and isopropenyl stearate containing a catalytic amount of PTSA. The cotton was taken from an 80×80 cotton print cloth weighing 3.20 oz./sq.yd. which had been desized, scoured, bleached, and soured.

EXAMPLE 1

Isopropenyl stearate (IPS) in which had been dissolved 0.05% PTSA was applied neat by sprinkling it in powder form onto a piece of cotton fabric. An electric iron, equipped with a indicating thermocouple at 190° C. was pressed against the chemically saturated cotton cloth for one second whereupon the melt liquified and completely covered and impregnated the cloth. The cloth was extracted with methylene chloride in a Soxhlet extractor for four hours to remove unreacted IPS and PTSA and the cotton was then dried at 105° C. in a warm air oven. Water sprayed on the treated cotton cloth formed globules on the fabric surface which were easily shaken off leaving the surface dry. The fabric was readily wetted by organic liquids such as chloroform, diethyl ether, perchlorethylene, benzene, and ethanol without affecting the water repellant properties. The tear strength, color, appearance, hand or fibrous form of the cotton cloth was not significantly altered by the process of this invention.

EXAMPLE 2

Cotton fabric was treated as in Example 1 except that the electric iron was pressed against the cloth for 15 seconds. The treated cloth exhibited the properties described in Example 1.

EXAMPLE 3

Cloth fabric was treated as in Example 1 except that temperature, time, and percent concentration of PTSA were varied as shown in Table 1.

EXAMPLE 4

The effect of several parameters on tensile strength and water repellancy was determined. The parameters were the nature of the catalyst, that is, β-napthalenesulfonic acid versus PTSA versus partially dehydrated phosphoric acid; the ester (IPS) application method, neat versus solution; and the method of curing, iron versus oven. Neat application was as a liquid melt. Response was measured in terms of water repellancy as well as of change in warp tensile strength over that of untreated cloth. The results are shown in Table 2.

In practicing the invention, heating to effect chemical reaction was accomplished by direct application of a heated flat iron to the treated material under preselected conditions. The temperature of the iron was closely controlled with a thermostat contained in the sole plate. Since the area of the treated cloth was approximately twice the area of the iron, the latter was moved over the surface of the sample for twice the period indicated, so that each spot on the cloth received heating for the prescribed period. The other side of the sample was then heated in a similar manner and for the same period. The brief intervals of exposure to the high temperature of the iron were insufficient to cause thermal or oxidative damage to the cellulosic material. Curing was also carried out by exposing the material attached to a pin frame, to oven heat for the prescribed period.

With regard to temperature, we found that at 130° C. little acylation occurred even in prolonged heating, while at 270° C., and more so at 320° C., the physical properties of the cloth degenerated because of scorching.

The preferred treatment which results in excellent water repellancy combined with a significant retention in tensile strength (W-direction) and an essentially unaltered tensile strength (F-direction) is the combination of neat application and ironing at 180° C. for 4 seconds with 0.05% PTSA.

Determination of the amount of acylation by weighing cloth samples before and after treatment is unsatisfactory because the weights of air-equilibrated samples before and after treatment by the process of this invention is the same within experimental error. Water repellancy is achieved by esterification of an unexpectedly small number of available cellulose hydroxyl function so that add-on cannot be determined gravemetrically with confidence. It is necessary to determine the degree of substitution by an alternative method which will be published in the near future in Textile Res. J. The method involves saponification with methanolic or propanolic KOH followed by isolation and gas liquid chromatographic determination of the isolated fatty acids.

In the process of this invention, degrees of substitution in the order of magnitude of $1\times10^{-3}$ are obtained. These low degrees of substitution indicate that only one out of every one thousand anhydroglucose units bears a substituent. When fully considered, in view of the excellent water repellancy attained with extremely high retention of tensile strength at such a low order of substitution, the process and products of this invention are remarkable improvements over that which is presently available.

Table 1[1]

| Temp °C. | PTSA[2] % | Time sec. | Warp Thickness in. | Warp Elongation at break % | Warp Breaking strength lb. | Warp Tensile strength psi | Fill Thickness in. | Fill Elongation at break % | Fill Breaking strength lb. | Fill Tensile strength psi | Water repellancy |
|---|---|---|---|---|---|---|---|---|---|---|---|
| Untreated cloth | | | 0.00934 | 15 | 52 | 5560 | 0.00900 | 33 | 36 | 4015 | 0 |
| 180 | .05 | 4 | .00953 | 16 | 57 | 6005 | .00939 | 31 | 37 | 3950 | 100 |
| 210 | .05 | 4 | .00918 | 14 | 46 | 5005 | .00925 | 31 | 29 | 3085 | 100 |
| 210 | .005 | 7 | .00948 | 16 | 55 | 5825 | .00924 | 32 | 38 | 4095 | 50 |
| 180 | .05 | 7 | .00919 | 16 | 53 | 5810 | .00937 | 32 | 34 | 3625 | 100 |
| 210 | .05 | 7 | .00923 | 14 | 47 | 5885 | .00932 | 30 | 31 | 3300 | 100 |

[1]Treated samples: average of 3 samples; untreated control: average of 6 samples
[2]Percent by weight, p-toluenesulfonic acid.

TABLE 2[1]

| Catalyst | Application | Cure | TS, p.s.i. Warp | TS, p.s.i. Fill | WR[3] |
|---|---|---|---|---|---|
| Control[4] | | Iron | 5210 | 3700 | 0 |
| | | Oven | 5190 | 3880 | 0 |
| β-Napthalene-sulfonic acid | Neat | Iron | 4900 | 3740 | 90 |
| | Neat | Oven | 4310 | 2960 | 80 |
| | Solution[2] | Iron | 5080 | 3600 | 70 |
| | Solution[2] | Oven | 5250 | 3820 | 70 |
| p-Toluenesulfonic acid | Neat | Iron | 4660 | 4320 | 90 |
| | Neat | Oven | 4800 | 3480 | 90 |
| | Solution[2] | Iron | 5520 | 3970 | 70Z |
| | Solution[2] | Oven | 4720 | 3490 | 70 |
| $H_3PO_4/P_2O_5$ | Neat | Iron | 4960 | 3470 | 90 |
| | Neat | Oven | 4040 | 3380 | 80 |
| | Solution[2] | Iron | 5340 | 4160 | 50 |
| | Solution[2] | Oven | 5400 | 3950 | 0 |

[1]Each value represents the average of four sample values.
[2]Solution in benzene solvent.
[3]Water repellency (WR) measured by AATCC Test Method 22-1971.
[4]Untreated cloth.

We claim:

1. A process for imparting water repellancy to fibrous cellulosic textile material comprising applying to said material an isopropenyl ester having mixed therein a catalytic amount of an acid catalyst and then heat curing the ester treated textile material at an effective curing temperature, said process imparting the property of water repellancy to the material at a very low degree of substitution and with a high degree of retention of tensile strength wherein the catalytic amount of said acid catalyst is sufficient to impart a degree of substitution in the order of magnitude of $1\times10^{-3}$.

2. The process of claim 1 in which the isopropenyl ester is isopropenyl stearate.

3. The process of claim 2 in which the acid catalyst is PTSA.

4. The process of claim 3 in which the mole ratio of PTSA to ester is about $8.5\times10^{-4}$:1.

5. The process of claim 3 in which the acid catalyst is β-naphthalene sulfonic acid.

6. The process of claim 3 in which the catalyst is partially dehydrated phosphoric acid.

7. The process of claim 4 in which the ester is applied neat as a liquid melt.

8. The process of claim 4 in which the ester is applied neat as a powder.

9. The process of claim 4 in which the ester is applied as a solution.

10. The product of the process of claim 1.

11. A process for imparting water repellancy to fibrous cellulosic textile material comprising applying to said material an isopropenyl ester having mixed therein a catalytic amount of an acid catalyst, said ester having a fatty moiety containing from 8 to 22 carbon atoms, and curing the treated textile material by heating it at an effective curing temperature for from about one second to about fifteen seconds, said process being effective to impart water repellancy to said material at a low degree of substitution and with high degree of retention of tensile strength wherein the catalytic amount of said acid catalyst is sufficient to impart a degree of substitution in the order of magnitude of $1\times10^{-3}$.

12. The process of claim 11 wherein the textile material is cotton cloth, the ester is isopropenyl stearate, the ester-catalyst mixture contains from 0.005 to 0.05% PTSA, by weight, the ester-catalyst is applied neat as a powder, and the ester treated cloth is cured at about 180° C.

13. The process of claim 12 wherein the ester-catalyst mixture contains 0.05% PTSA, by weight, and the treated cloth is heat cured for about four seconds.

14. The product of the process of claim 13.

* * * * *